US009951963B2

(12) United States Patent
Lee

(10) Patent No.: US 9,951,963 B2
(45) Date of Patent: Apr. 24, 2018

(54) HYBRID HEAT PUMP APPARATUS

(71) Applicant: KYUNGDONG NAVIEN CO., LTD, Pyeongtaek-si, Gyeonggi-do (KR)

(72) Inventor: Dong Keun Lee, Seongnam-si (KR)

(73) Assignee: KYUNGDONG NAVIEN CO., LTD, Pyeongtaek-si, Gyeonggi-do (KR)

( * ) Notice: Subject to any disclaimer, the term of this patent is extended or adjusted under 35 U.S.C. 154(b) by 2 days.

(21) Appl. No.: 15/305,594

(22) PCT Filed: Apr. 13, 2015

(86) PCT No.: PCT/KR2015/003683
§ 371 (c)(1),
(2) Date: Oct. 20, 2016

(87) PCT Pub. No.: WO2015/163621
PCT Pub. Date: Oct. 29, 2015

(65) Prior Publication Data

US 2017/0045242 A1 Feb. 16, 2017

(30) Foreign Application Priority Data

Apr. 21, 2014 (KR) ..... 10-2014-0047256

(51) Int. Cl.
*F23L 15/02* (2006.01)
*F24F 3/00* (2006.01)
(Continued)

(52) U.S. Cl.
CPC ..... *F24F 3/001* (2013.01); *F24D 15/04* (2013.01); *F24F 3/1423* (2013.01); *F25B 13/00* (2013.01);
(Continued)

(58) Field of Classification Search
CPC ..... F24F 3/001; F24F 3/1423; F24F 5/0089; F24F 7/08; F24F 2003/1464;
(Continued)

(56) References Cited

U.S. PATENT DOCUMENTS 4,165,952 A * 8/1979 Bennett ..... C02F 1/14 417/207
4,474,021 A * 10/1984 Harband ..... F24F 3/1423 62/271
(Continued)

FOREIGN PATENT DOCUMENTS

JP S59-208347 A 11/1984
JP 2002-022291 A 1/2002
(Continued)

*Primary Examiner* — Davis Hwu
(74) *Attorney, Agent, or Firm* — Novick, Kim & Lee, PLLC; Jae Youn Kim

(57) ABSTRACT

The present invention relates to a hybrid heat pump apparatus comprising: a housing having a first channel and a second channel formed therein; a dehumidifying rotor disposed in the housing; a heating unit disposed in the first channel and heating air passing therethrough; a cooling unit disposed in the second channel and selectively cooling air passing therethrough; a coolant circulating unit including a compressor, a first heat exchanger disposed in the second channel, a second heat exchanger, and a four-way valve; and a water circulating pipe through which water circulates and which is connected to the second heat exchanger for heat exchanging between the circulating water and coolant in the second heat exchanger.

20 Claims, 6 Drawing Sheets

(51) Int. Cl.

| | |
|---|---|
| ***F25B 13/00*** | (2006.01) |
| ***F25B 30/00*** | (2006.01) |
| ***F24D 15/04*** | (2006.01) |
| ***F24F 3/14*** | (2006.01) |
| *F24F 5/00* | (2006.01) |
| *F24F 7/08* | (2006.01) |

(52) U.S. Cl.
CPC ..... *F25B 30/00* (2013.01); *F24F 5/0089* (2013.01); *F24F 7/08* (2013.01); *F24F 2003/1464* (2013.01); *F24F 2203/021* (2013.01); *F24F 2203/1032* (2013.01); *F24F 2221/34* (2013.01); *F24F 2221/54* (2013.01)

(58) Field of Classification Search
CPC ..... F24F 2203/021; F24F 2203/1032; F24F 2221/34; F24F 2221/54; F24D 15/02; B60H 1/00278; B60H 1/00907; F25B 13/00; F25B 30/00
USPC ..... 165/8
See application file for complete search history.

(56) References Cited

U.S. PATENT DOCUMENTS 6,077,158 A * 6/2000 Lake ..... B60H 1/00278 165/249
6,118,099 A * 9/2000 Lake ..... B60H 1/00907 165/43

FOREIGN PATENT DOCUMENTS

| | | | |
|---|---|---|---|
| JP | 2002-364879 | A | 12/2002 |
| JP | 2006-052914 | A | 2/2006 |
| JP | 2006-341217 | A | 12/2006 |
| JP | 2007-278594 | A | 10/2007 |
| JP | 2008-070060 | A | 3/2008 |
| JP | 2012-172880 | A | 9/2012 |
| JP | 2012-211715 | A | 11/2012 |
| JP | 2014-016090 | A | 1/2014 |
| KR | 10-2004-0057265 | A | 7/2004 |
| KR | 10-2012-0022684 | A | 3/2012 |
| WO | 2011-099059 | A1 | 8/2011 |

* cited by examiner

HYBRID HEAT PUMP APPARATUS

TECHNICAL FIELD

The present invention relates to a hybrid heat pump apparatus capable of performing both cooling and heating functions together with a dehumidification function.

BACKGROUND ART

Electric heat pumps are known as conventional cooling/heating apparatuses. Electric heat pumps are usually used as cooling/heating apparatuses since they may rapidly perform cooling and heating, be inexpensive, and be easily installed.

However, such electric heat pumps have a disadvantage in that a large amount of electric energy is consumed and heating performance is rapidly deteriorated as ambient air temperature is lowered. The electric heat pumps also have a problem in that it is impossible to perform a heating operation while they are operated in a defrost mode.

Meanwhile, dehumidifying and cooling techniques have been actively studied for interior cooling. A dehumidifying and cooling technique performs cooling by controlling a latent heat load using a dehumidifier and reducing temperature using evaporation heat.

In more detail, the dehumidifying and cooling technique performs a process of removing a latent heat load by removing moisture contained in air using a dehumidifier, and of evaporating the dehumidified and dried air by supplying moisture thereto so as to reduce the temperature of the air using evaporation heat, and performs cooling by forming a circulation cycle such that the process is repeated.

The dehumidifying and cooling technique is a new and renewable energy technique in terms of low energy consumption and eco-friendliness, and has been continuously developed.

By way of example of the dehumidifying and cooling technique, there is Korean Patent Application Publication No. 10-2012-0022684 entitled "Dehumidifying and cooling apparatus".

The dehumidifying and cooling apparatus disclosed in the above patent application includes a housing, a dehumidifying module including a first casing, which is disposed in the housing and has interior and exterior passages formed therein by a partition wall, and a desiccant rotor, which is rotatably installed over the interior and exterior passages of the first casing, a regeneration module including a second casing, which is disposed in the housing and has interior and exterior passages formed therein by a partition wall, and a regenerator, which heats air passing through one of the interior and exterior passages, and a cooling module including a third casing, which is disposed in the housing and has interior and exterior passages formed therein by a partition wall, and a sensible rotor which is rotatably installed over the interior and exterior passages of the third casing, wherein the first to third casings are detachably mounted to the housing, and thus the housing has two channels which are partitioned from each other therein.

Conventional dehumidifying and cooling apparatuses including the above patent application have an advantage in terms of low energy consumption and eco-friendliness.

However, the dehumidifying and cooling apparatuses have a disadvantage in that they are applicable only to a structure having equipment (e.g. an air circulation duct) through which air cooled by passing through a dehumidification passage may be supplied back to the inside thereof.

In addition, the structure must be further provided with a separate blower which allows cooling air to be smoothly circulated along a supply path thereof. The blower must be usually a blower having high static pressure and high airflow. For this reason, the conventional dehumidifying and cooling apparatuses also have a disadvantage of increasing electricity consumption.

Moreover, the conventional dehumidifying and cooling apparatuses may be used for only interior cooling. Hence, there is a problem in that heating apparatuses such as the above electric heat pumps must be separately provided for interior heating.

DISCLOSURE

Technical Problem

The present invention has been made in view of the above-mentioned problems, and it is an object of the present invention to provide a hybrid heat pump apparatus to which a dehumidifying and cooling technique is applied. In addition, the hybrid heat pump apparatus can be also applied to a structure which is not provided with an air circulation duct, and can perform both cooling and heating functions.

Technical Solution

In accordance with a first aspect of the present invention, there is provided a hybrid heat pump apparatus including a housing, a first channel formed in the housing such that first air passes through the first channel, a second channel formed in the housing such that second air passes through the second channel, a desiccant rotor rotatably installed in the housing while being disposed over the first and second channels, so that the desiccant rotor is dried by the first air passing therethrough and absorbs moisture from the second air passing therethrough, a heating unit disposed upstream of the desiccant rotor so as to be closer to an introduction side of the first air in the first channel, the heating unit serving to heat the first air passing therethrough, and a cooling unit disposed downstream of the desiccant rotor so as to be closer to a discharge side of the second air in the second channel, the cooling unit serving to selectively cool the second air passing therethrough. In addition, the hybrid heat pump apparatus includes a refrigerant circulation unit including a compressor, a first heat exchanger, a second heat exchanger, and a four-way valve, the first heat exchanger being disposed downstream of the cooling unit so as to be closer to the discharge side of the second air in the second channel, a refrigerant being circulated in the refrigerant circulation unit in order of the compressor, the first heat exchanger, the second heat exchanger, and the compressor or vice versa, according to control of the four-way valve, and a water circulation pipe in which water is circulated, the water circulation pipe being connected to the second heat exchanger such that the water circulating therein exchanges heat with the refrigerant in the second heat exchanger.

In accordance with a second aspect of the present invention, there is provided a hybrid heat pump apparatus including a housing, a first channel formed in the housing such that first air passes through the first channel, a second channel formed in the housing such that second air passes through the second channel, a third channel formed in the housing such that third air passes through the third channel, a desiccant rotor rotatably installed in the housing while being disposed over the first, second, and third channels, so that the desiccant rotor is dried by the first air passing therethrough and absorbs moisture from the second air and the third air passing therethrough, a heating unit disposed upstream of the desiccant rotor so as to be closer to an introduction side of the first air in the first channel, the heating unit serving to heat the first air passing therethrough, a first cooling unit disposed downstream of the desiccant rotor so as to be closer to a discharge side of the second air in the second channel, the first cooling unit serving to selectively cool the second air passing therethrough, and a second cooling unit disposed downstream of the desiccant rotor so as to be closer to a discharge side of the third air in the third channel, the second cooling unit serving to cool the third air passing therethrough. In addition, the hybrid heat pump apparatus includes a refrigerant circulation unit including a compressor, a first heat exchanger, a second heat exchanger, and a four-way valve, the first heat exchanger being disposed downstream of the cooling unit so as to be closer to the discharge side of the second air in the second channel, a refrigerant being circulated in the refrigerant circulation unit in order of the compressor, the first heat exchanger, the second heat exchanger, and the compressor or vice versa, according to control of the four-way valve, and a water circulation pipe in which water is circulated, the water circulation pipe being connected to the second heat exchanger such that the water circulating therein exchanges heat with the refrigerant in the second heat exchanger.

In the first and second aspects of the present invention, the hybrid heat pump apparatus may further include a third heat exchanger connected to the water circulation pipe such that the water circulating in the water circulation pipe via the second heat exchanger exchanges heat with a heat source which is selectively supplied to the third heat exchanger.

In the first and second aspects of the present invention, the third heat exchanger may be connected to a hot water pipe which is selectively supplied with hot water, and the water circulating in the water circulation pipe may exchange heat with the hot water, as the heat source, flowing in the hot water pipe.

In the first and second aspects of the present invention, the hybrid heat pump apparatus may further include a third heat exchanger connected to the water circulation pipe such that the water circulating in the water circulation pipe via the second heat exchanger exchanges heat with a heat source which is selectively supplied to the third heat exchanger, the heating unit may include a hot water coil, the third heat exchanger may be connected to a hot water pipe which is selectively supplied with hot water, the water circulating in the water circulation pipe may exchange heat with the hot water, as the heat source, flowing in the hot water pipe, and a water inlet pipe into which hot water is introduced, a supply pipe of the hot water pipe connected to the third heat exchanger, and an inlet pipe connected to an inlet of the hot water coil may be interconnected by a three-way valve.

In the first aspect of the present invention, the hybrid heat pump apparatus may further include a first blower disposed in the first channel such that the first air forcibly passes through the first channel, and a second blower disposed in the second channel such that the second air forcibly passes through the second channel.

In the second aspect of the present invention, the hybrid heat pump apparatus may further include a first blower disposed in the first channel such that the first air forcibly passes through the first channel, a second blower disposed in the second channel such that the second air forcibly passes through the second channel, and a third blower disposed in the third channel such that the third air forcibly passes through the third channel.

In the first aspect of the present invention, the first or second blower may be selectively operated or stopped by a controller. In the second aspect of the present invention, the first, second, or third blower may be selectively operated or stopped by a controller.

In the first and second aspects of the present invention, at least a portion of the water circulation pipe may be disposed within at least one of an interior floor, an interior ceiling, and an interior wall.

In the first and second aspects of the present invention, at least a portion of the water circulation pipe may be disposed in a fan coil unit.

In the first and second aspects of the present invention, the first air may be air introduced into the first channel from the outside, and the first air passing through the first channel may be discharged to the outside.

In the first and second aspects of the present invention, the second air may be air introduced into the second channel from the outside, and the second air may be discharged to the outside after heat exchange in the first heat exchanger.

In the first and second aspects of the present invention, the hybrid heat pump apparatus may further include a water supply unit disposed in the second channel so as to spray water on a surface of the first heat exchanger.

In the first and second aspects of the present invention, the heating unit may include a hot water coil.

In the second aspect of the present invention, the third air may be air introduced into the third channel from the inside, and the third air passing through the third channel may be discharged to the inside.

In the second aspect of the present invention, the hybrid heat pump apparatus may further include a damper disposed between the second and third channels, the second channel communicating with the third channel by opening/closing of the damper.

In the second aspect of the present invention, the hybrid heat pump apparatus may further include an air filter disposed in the third channel.

The above and other objects, features and other advantages of the present invention will be more clearly understood from the following detailed description taken in conjunction with the accompanying drawings.

Advantageous Effects

In accordance with the present invention, since a conventional dehumidifying and cooling technique is applied to a hybrid heat pump apparatus, the hybrid heat pump apparatus can have high energy efficiency and performs an eco-friendly cooling function. In addition, the hybrid heat pump apparatus can perform a heating function even when it does not include a separate heating apparatus.

In addition, when the heat pump apparatus is operated in a cooling mode, dehumidified and cooled air is used to condense a refrigerant without being supplied to the inside. In such a refrigerant circulation process, the water circulating in a water circulation pipe is cooled and the inside is cooled by means of the water circulation pipe in which the cooled water is circulated. Therefore, the hybrid heat pump apparatus can be applied to a structure for interior cooling even when it is not provided with a separate air circulation duct.

In addition, when the hot water supplied to a hot water coil during operation in the cooling mode or the hot water supplied through a hot water pipe during operation in the heating mode uses hot water heated by recycling waste heat, it is possible to improve energy efficiency.

In addition, when a defrost operation is required during operation in the heating mode, heating can be continuously performed without interruption. Therefore, it is possible to resolve inconvenience due to the interruption of heating.

Furthermore, since hot water and outdoor air are properly used as a heat source during operation in the heating mode, it is possible to efficiently realize required heating performance and thus to save energy.

MODE FOR INVENTION

Hereinafter, a hybrid heat pump apparatus according to exemplary embodiments of the present invention will be described in detail with reference to the accompanying drawings.

Figure 1:
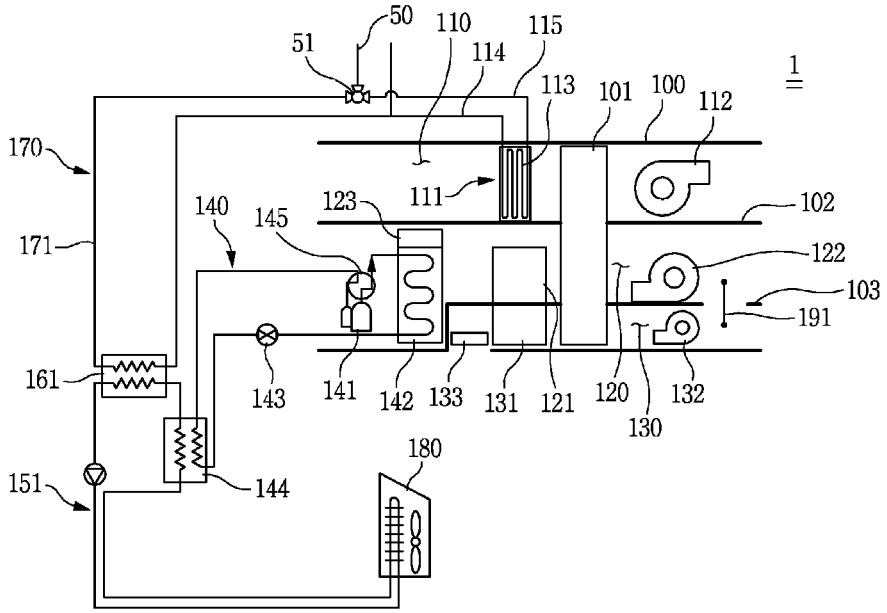
FIG. 1 is a diagram schematically illustrating a hybrid heat pump apparatus according to an embodiment of the present invention.

FIG. 1 is a diagram schematically illustrating a hybrid heat pump apparatus according to an embodiment of the present invention.

As illustrated in FIG. 1, the hybrid heat pump apparatus, which is designated by reference numeral 1, according to the embodiment of the present invention includes a housing 100, a desiccant rotor 101, a heating unit 111, a cooling unit 121, a refrigerant circulation unit 140, and a water circulation pipe 151.

The housing 100 has first and second channels 110 and 120 formed therein in the state in which they are partitioned by a partition wall 102, air passing through the first and second channels 110 and 120.

The air passing through the first channel 110 may be defined as first air. The first air may be, for instance, air introduced into the first channel 110 from the outside. The first air may be discharged to the outside after passing through the first channel 110.

The heating unit 111 is disposed in the first channel 110. In this case, the heating unit 111 is disposed upstream of the desiccant rotor 101, which will be described in detail later, so as to be closer to the introduction side of the first air, namely, is disposed closer to the left of the first channel 110 in the drawing. The first air passing through the first channel 110 passes through the desiccant rotor 101 via the heating unit 111.

The heating unit 111 may include, for instance, a heat coil so as to provide heat using electric resistance. Alternatively, the heating unit 111 may include, for instance, a hot water coil 113 so as to provide heat using hot water.

When the heating unit 111 includes the hot water coil 113, an inlet pipe 114 may be formed at the inlet of the hot water coil 113. An outlet pipe 115 may be formed at the outlet of the hot water coil 113.

The inlet pipe 114 is connected to a water inlet pipe 50. The hot water supplied through the water inlet pipe 50 is supplied to the hot water coil 113 through the inlet pipe 114, and is then discharged through the outlet pipe 115 after flowing in the hot water coil 113.

Here, the hot water supplied through the water inlet pipe 50 may be hot water for district heating, which is heated using waste heat generated when electricity is generated in a factory or a cogeneration plant. In this case, it is possible to efficiently use energy by recycling waste heat.

The first air passing through the heating unit 111 is heated by heat exchange with the hot water flowing in the hot water coil 113. The first air heated by the heating unit 111 dries the desiccant rotor 101 while passing through the desiccant rotor 101.

The desiccant rotor 101 is rotatably disposed in the housing 100. The desiccant rotor 101 is disposed over the first and second channels 110 and 120.

The desiccant rotor 101 has an absorbent, such as silica gel or zeolite, which is formed on the contact surface with air, and may absorb moisture from the air passing therethrough.

The air passing through the second channel 120 may be defined as second air. The second air may be, for instance, air introduced from the outside. The second air is dehumidified by the desiccant rotor 101 while passing through the desiccant rotor 101.

The cooling unit 121 is disposed in the second channel 120. In this case, the cooling unit 121 is disposed downstream of the desiccant rotor 101 so as to be closer to the discharge side of the second air, namely, is disposed closer to the left of the second channel 120 in the drawing. The second air passing through the second channel 120 passes through the cooling unit 121 via the desiccant rotor 101.

The cooling unit 121 cools the second air which is dehumidified by passing through the desiccant rotor 101. The cooling unit 121 may be, for instance, an evaporative cooler which sprays water on second air passing therethrough so as to cool the second air in the process of evaporating the sprayed water.

The second air is selectively cooled by operating the cooling unit 121 to spray water or stopping the operation of the cooling unit 121 by a controller. In other words, when the cooling unit 121 is controlled to be operated by the controller, the second air passing through the cooling unit 121 is cooled by the cooling unit 121. However, when the operation of the cooling unit 121 is stopped by the controller, the second air passing through the cooling unit 121 is not cooled.

Although described in more detail later, when the heat pump apparatus 1 according to the embodiment is operated in a heating mode, the operation of the cooling unit 121 is stopped. Consequently, the second air, which has passed through the desiccant rotor 101, is not cooled, but flows to a first heat exchanger 142 to be described later.

The refrigerant circulation unit 140 constitutes a circuit in which a refrigerant is circulated. The refrigerant circulation unit 140 includes a compressor 141 which compressed a refrigerant, a first heat exchanger 142 in which a refrigerant is condensed or evaporated by heat exchange, and a second heat exchanger 144 in which a refrigerant is evaporated or condensed by heat exchange.

In this case, the first heat exchanger 142 is disposed in the second channel 120. The first heat exchanger 142 is disposed downstream of the cooling unit 121 so as to be closer to the discharge side of the second air.

An expansion valve 143 for expanding a refrigerant may be disposed between the first and second heat exchangers 142 and 144.

The refrigerant circulation unit 140 includes a four-way valve 145 for changing the circulation direction of a refrigerant when the operation mode of the heat pump apparatus 1 is switched to a cooling mode or a heating mode. The four-way valve 145 is controlled by the controller and serves to change the circulation direction of a refrigerant.

For example, when the heat pump apparatus 1 is operated in the cooling mode, a refrigerant may be circulated so as to return to the compressor 141 after passing through the compressor 141, the first heat exchanger 142, the expansion valve 143, and the second heat exchanger 144. In this case, the first heat exchanger 142 functions as a condenser, and the second heat exchanger 144 functions as an evaporator.

For example, when the heat pump apparatus 1 is operated in the heating mode, a refrigerant may be circulated so as to return to the compressor 141 after passing through the compressor 141, the second heat exchanger 144, the expansion valve 143, and the first heat exchanger 142. In this case, the first heat exchanger 142 functions as an evaporator, and the second heat exchanger 144 functions as a condenser.

Meanwhile, in order to further lower the condensation temperature of the refrigerant in the first heat exchanger 142 functioning as a condenser during operation in the cooling mode, the heat pump apparatus 1 according to the embodiment may further include a water supply unit 123 which sprays water on the first heat exchanger 142.

The water supply unit 123 is disposed in the second channel 120, and may be controlled such that the water supply unit 123 is operated or the operation thereof is stopped by the controller.

When water is sprayed on the surface of the first heat exchanger 142 by the operation of the water supply unit 123, the heat of the second air passing through the second channel 120 is absorbed as the evaporative latent heat of the water sprayed on the surface of the first heat exchanger 142 so that the second air is further cooled. Therefore, the condensation temperature of the refrigerant, which exchanges heat with the second air, is further lowered, and it is thus possible to increase condensing efficiency.

However, during operation in the heating mode in which the first heat exchanger 142 functions as an evaporator, the operation of the water supply unit 123 is stopped by the controller.

The water circulation pipe 151 is a pipe through which water is circulated, and is connected to the second heat exchanger 144. The second heat exchanger 144 may be a plate-type heat exchanger. The water circulating through the water circulation pipe 151 may exchange heat with the refrigerant in the second heat exchanger 144.

As described above, the second heat exchanger 144 serves as an evaporator or a condenser according to the control of the four-way valve 145.

When the second heat exchanger 144 functions as an evaporator, the water circulating in the water circulation pipe 151 is cooled by heat exchange in the second heat exchanger 144. The water circulation pipe 151, in which the cooled water is circulated, may be used to cool the inside of a structure.

When the second heat exchanger 144 functions as a condenser, the water circulating in the water circulation pipe 151 is heated by heat exchange in the second heat exchanger 144. The water circulation pipe 151, in which the heated water is circulated, may be used to heat the inside of a structure.

Meanwhile, when the heat pump apparatus 1 is operated in the heating mode, the heat pump apparatus 1 according to the embodiment may further include a third heat exchanger 161 such that the water in the water circulation pipe 151, which is heated by heat exchange in the second heat exchanger 144, may be further heated.

The third heat exchanger 161 is connected to the water circulation pipe 151. The water circulating in the water circulation pipe 151 passes through the third heat exchanger 161 via the second heat exchanger 144. The water circulating in the water circulation pipe 151 may be heated by heat exchange with a heat source supplied to the third heat exchanger 161. The heat source may be, for instance, hot water.

In more detail, the third heat exchanger 161 may be connected to a hot water pipe 170. The water circulating in the water circulation pipe 151 may be heated by heat exchange with the hot water flowing through the hot water pipe 170 in the third heat exchanger 161.

In this case, the third heat exchanger 161 may be a plate-type heat exchanger, similar to the second heat exchanger 144.

Meanwhile, since the heat exchange in the third heat exchanger 161 is performed during operation in the heating mode, the heat source supplied to the third heat exchanger 161 is supplied only during operation in the heating mode whereas it is not supplied during operation in the cooling mode.

That is, the supply of hot water through the hot water pipe 170 is selectively performed. For example, hot water may be controlled by the opening/closing of a valve for allowing or blocking the supply of hot water to the hot water pipe 170 so that the hot water is supplied to the hot water pipe 170 only during operation in the heating mode whereas it is not supplied thereto during operation in the cooling mode.

In this case, a supply pipe 171 of the hot water pipe 170 connected to the third heat exchanger 161 may be connected to the water inlet pipe 50 in order to supply hot water thereto. In this case, the water inlet pipe 50, the supply pipe 171 of the hot water pipe 170, and the inlet pipe 114 connected to the inlet of the hot water coil 113 may be interconnected by a three-way valve 51.

The hot water introduced through the water inlet pipe 50 may be supplied to the hot water coil 113 through the inlet pipe 114, or to the third heat exchanger 161 through the supply pipe, according to the control of the three-way valve 51. Alternatively, the hot water may not be supplied to both of the inlet pipe 114 and the supply pipe 171 according to the control of the three-way valve 51.

The water circulating in the water circulation pipe 151 is cooled or heated by passing through the second heat exchanger 144 or the second and third heat exchangers 144 and 161 depending on the operation mode of the heat pump apparatus 1. The water circulation pipe 151, in which the cooled or heated water is circulated, may be utilized for interior cooling or heating, and a specific example thereof is as follows.

Although not illustrated in the drawing, at least a portion of the water circulation pipe 151 may be disposed within any one of an interior floor, an interior ceiling, and an interior wall. The inside may be cooled or heated in a panel cooling or heating manner by disposing the water circulation pipe 151 within the interior floor, the interior ceiling, or the interior wall.

Alternatively, a portion of the water circulation pipe 151 may be is disposed in a fan coil unit 180 which is arranged inside a structure, as illustrated in the drawing, and the inside of the structure may be cooled or heated by operating the fan coil unit 180.

Meanwhile, the first air may forcibly pass through the first channel 110 by operating a first blower 112 disposed in the first channel 110. Similarly, the second air may forcibly pass through the second channel 120 by operating a second blower 122 disposed in the second channel 120.

Each of the first and second blowers 112 and 122 may be controlled to be operated or stopped by a controller (not shown).

The heat pump apparatus 1 according to the embodiment may further include a third channel 130 which is formed in the housing 100 and through which air passes. The second and third channels 120 and 130 may be partitioned from each other by a partition wall 103 in the housing 100.

When the third channel 130 is further formed in the housing 100, the desiccant rotor 101 is disposed over the first to third channels 110 to 130 in the housing 100, as illustrated in the drawing.

A cooling unit 131 is disposed in the third channel 130. The cooling unit 131 is disposed downstream of the desiccant rotor 101 so as to be closer to the discharge side of third air, namely, is disposed closer to the left of the third channel 130 in the drawing.

The air passing through the third channel 130 may be defined as third air. The third air may be air introduced into the third channel 130 from the inside.

The third channel 130 may be connected to an interior ventilation duct, which is formed in a structure, such that indoor air is introduced into the third channel 130 and is then supplied back to the inside. The air introduced into the third channel 130 may be dehumidified and cooled while sequentially passing through the desiccant rotor 101 and the cooling unit 131. After the third air is cooled, the third air may be supplied back to the inside so as to dehumidify and cool the inside.

An air filter 133 may be disposed in the third channel 130 so as to remove dust, foreign substances, and the like in the third air passing through the third channel 130.

A third blower 132, which allows the third air to forcibly pass through the third channel 130, may be disposed in the third channel 130. The third blower 132 may be controlled so as to be operated or stopped by the controller, similar to the first and second blowers 112 and 122.

The controller may control the blowers such that only the first and second blowers 112 and 122 are operated, or may control the blowers such that all of the first to third blowers 112 to 132 are operated for interior cooling and dehumidification as occasion demands. Alternatively, the controller may control the blowers such that the first and second blowers 112 and 122 are stopped and only the third blower 132 is operated.

Meanwhile, in order to ventilate the inside when the heat pump apparatus 1 is operated in the cooling mode, the heat pump apparatus 1 according to the embodiment may further include a damper 191 disposed between the second and third channels 120 and 130.

The damper 191 allows the second channel 120 to selectively communicate with the third channel 130 depending on the opening/closing thereof. As illustrated in the drawing, when the damper 191 is opened, a portion of the outdoor air introduced into the second channel 120 may flow into the third channel 130, and a portion of the indoor air into the third channel 130 may be discharged to the second channel 120.

Consequently, the air supplied to the inside through the third channel 130 is a mixture (mixed air) of indoor air and outdoor air. The inside may be ventilated by supplying the mixed air thereto.

Hereinafter, the state for each operation mode of the heat pump apparatus 1 according to the embodiment will be described with reference to FIGS. 2 to 6.

Figure 2:
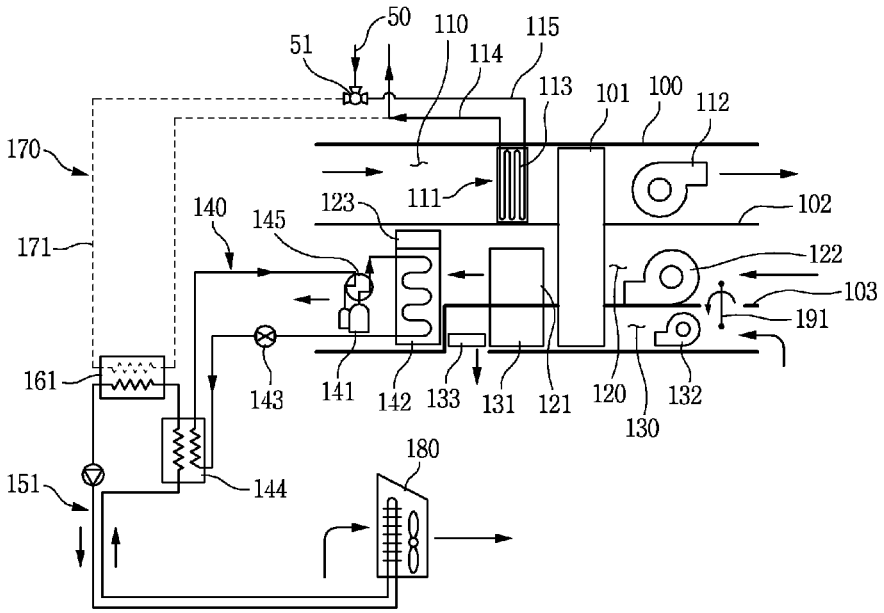
FIG. 2 is a diagram illustrating a state in which the heat pump apparatus illustrated in FIG. 1 is operated in a cooling mode.

FIG. 2 is a diagram illustrating a state in which the heat pump apparatus 1 illustrated in FIG. 1 is operated in the cooling mode.

As illustrated in the drawing, the hot water introduced into the water inlet pipe 50 flows only to the hot water coil 113 according to the control of the three-way valve 51 during operation in the cooling mode.

The first air passing through the first channel 110 is heated by the heating unit 111 including the hot water coil 113, and the heated first air dries the desiccant rotor 101 while passing through the desiccant rotor 101 which is rotating. The first air, which has passed through the desiccant rotor 101, is discharged to the outside.

The second air introduced into the second channel 120 from the outside is dehumidified while passing through the desiccant rotor 101 which is rotating. In the process in which the desiccant rotor 101 rotates, the desiccant rotor 101, which absorbs moisture from the second air, is dried by the first air, which is heated by passing through the first channel 110, and is regenerated again.

The second air, which is dehumidified by passing through the desiccant rotor 101, is cooled while passing through the cooling unit 121. The cooled second air flows to the first heat exchanger 142. In this case, the refrigerant compressed by the compressor 141 is circulated to the first heat exchanger 142 according to the control of the four-way valve 145.

The cooled second air condenses a refrigerant while passing through the first heat exchanger 142, and is then discharged to the outside.

In this case, when the water supply unit 123 is controlled to be operated by the controller, water is sprayed on the surface of the first heat exchanger 142, and the heat of the second air passing through the first heat exchanger 142 is absorbed as the evaporative latent heat of the water sprayed on the surface of the first heat exchanger 142 so that the second air is further cooled. Consequently, the condensation temperature of the refrigerant circulating in the first heat exchanger 142 may be further lowered, and it is thus possible to further reduce the power consumption of the compressor 141.

The refrigerant condensed by the first heat exchanger 142 is circulated to the second heat exchanger 144 via the expansion valve 143.

The water circulating in the water circulation pipe 151 is cooled by heat exchange with the refrigerant in the second heat exchanger 144. A portion of the water circulation pipe 151, in which the cooled water is circulated, is disposed in the fan coil unit 180, thereby enabling the inside to be cooled by the operation of the fan coil unit 180.

In this case, when the heat pump apparatus 1 according to the embodiment further includes the third channel 130 as described above, the third air, which is dehumidified and cooled by passing through the third channel 130, is supplied back to the inside by operating the third blower 132, thereby enabling the inside to be cooled and dehumidified.

In addition, a portion of indoor air is discharged to the outside through the second channel 120 while a portion of outdoor air is supplied to the inside through the third channel 130 by opening the damper 191, as illustrated in the drawing, thereby enabling the inside to be ventilated.

Figure 3:
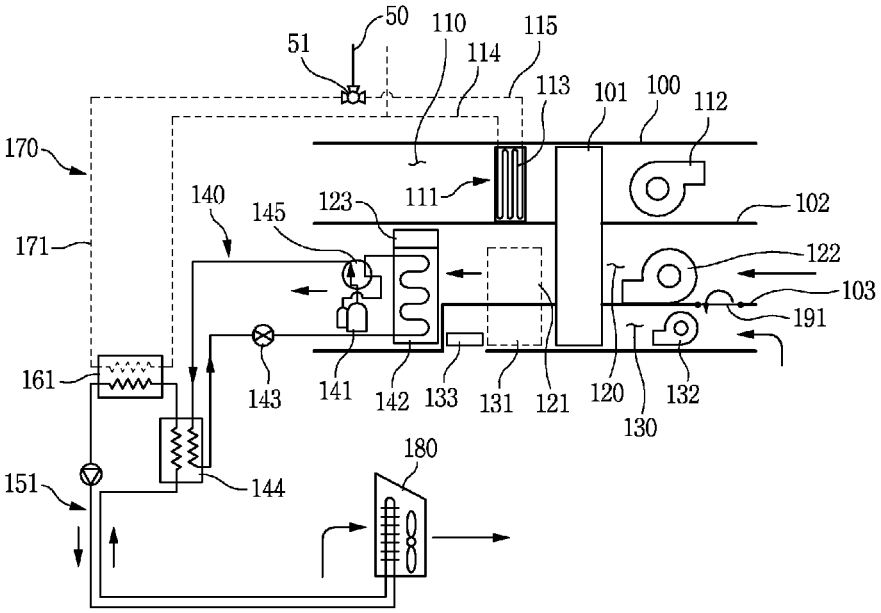
FIG. 3 is a diagram illustrating a state in which the heat pump apparatus illustrated in FIG. 1 is operated in a first heating mode.
Figure 5:
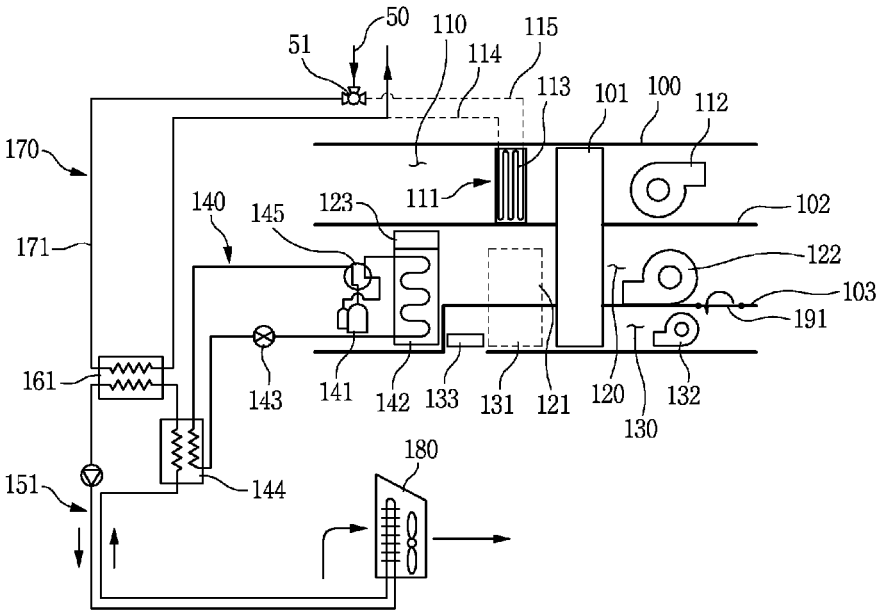
FIG. 5 is a diagram illustrating a state in which the heat pump apparatus illustrated in FIG. 1 is operated in a second heating mode.
Figure 6:
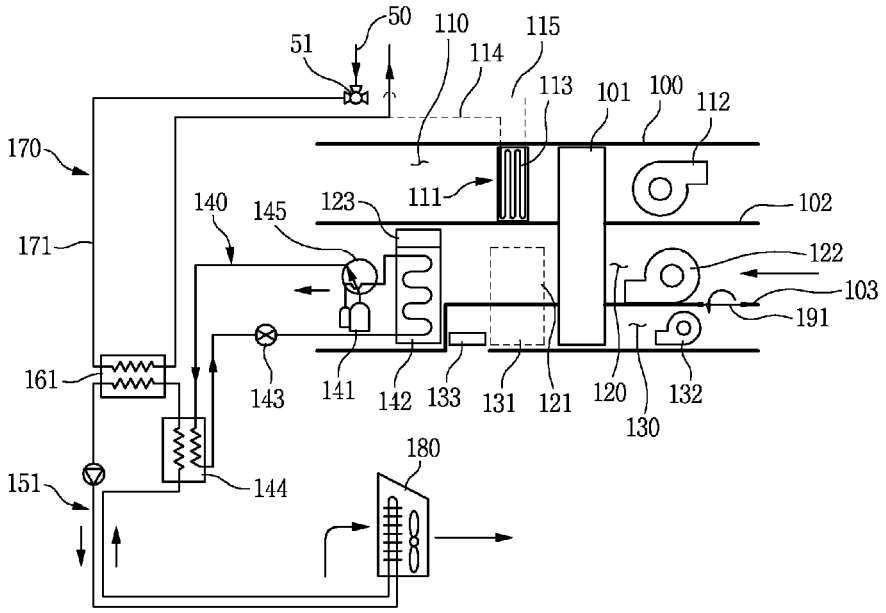
FIG. 6 is a diagram illustrating a state in which the heat pump apparatus illustrated in FIG. 1 is operated in a third heating mode.

FIGS. 3, 5, and 6 are diagrams illustrating a state in which the heat pump apparatus illustrated in FIG. 1 is operated in various operation modes.

FIG. 3 is a diagram illustrating a state in which the heat pump apparatus is operated in a first heating mode. In this case, the supply of hot water to the hot water coil 113 and the third heat exchanger 161 is blocked according to the control of the three-way valve 51.

The introduction of air into the first and third channels 110 and 130 is blocked by stopping the operation of the first and third blowers 112 and 132. The damper 191 is closed.

Outdoor air is introduced into the second channel 120 by the operation of the second blower 122, and the introduced outdoor air flows to the first heat exchanger 142 after passing through the desiccant rotor 101. In this case, the operation of the cooling unit 121 is stopped such that the outdoor air, which has passed through the desiccant rotor 101, is not cooled.

A refrigerant is circulated in a direction opposite to that during operation in the cooling mode according to the control of the four-way valve 145 in the refrigerant circulation unit 140. That is, the refrigerant compressed by the compressor 141 is circulated to the second heat exchanger 144, and is then circulated to the first heat exchanger 142 via the expansion valve 143.

The refrigerant circulating in the first heat exchanger 142 is evaporated by heat exchange with the second air, and is then introduced into the compressor 141 to be compressed therein. The refrigerant compressed by the compressor 141 is circulated to the second heat exchanger 144, in which case the second heat exchanger 144 functions as a condenser so that the water circulating in the water circulation pipe 151 is heated by heat exchange in the second heat exchanger 144.

A portion of the water circulation pipe 151, in which the heated water is circulated, is disposed in the fan coil unit 180, thereby enabling the inside to be heated by the operation of the fan coil unit 180.

Figure 4:
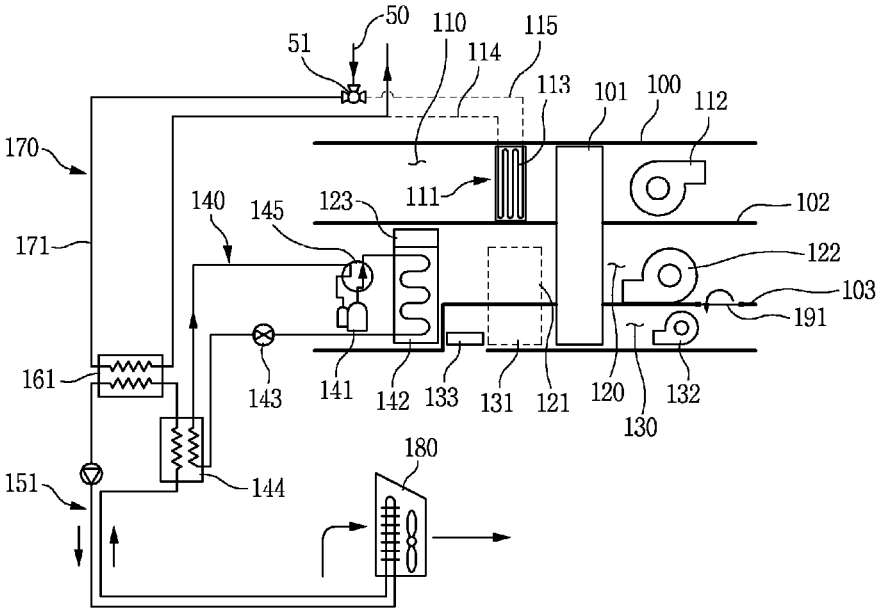
FIG. 4 is a diagram illustrating a state in which the heat pump apparatus illustrated in FIG. 1 is operated in a defrost mode.

FIG. 4 is a diagram illustrating a state in which the heat pump apparatus illustrated in FIG. 1 is operated in a defrost mode.

Frost may occur in the first heat exchanger 142 which functions as an evaporator during operation in the first heating mode. In this case, the heat pump apparatus 1 may be operated in the defrost mode in order to remove frost.

When the heat pump apparatus is operated in the defrost mode, the whole operation of the first to third blowers 112 to 132 is stopped.

The hot water introduced into the water inlet pipe 50 is supplied to the third heat exchanger 161 through the hot water pipe 170 according to the control of the three-way valve 51. The water circulating in the water circulation pipe 151 is heated by heat exchange in the third heat exchanger 161. Thus, it is possible to heat the inside by operating the fan coil unit 180.

The water circulating in the water circulation pipe 151 passes through the second heat exchanger 144 via the fan coil unit 180.

In this case, the refrigerant circulating in the refrigerant circulation unit 140 is circulated in the same direction as a direction, in which a refrigerant is circulated during operation in the cooling mode, according to the control of the four-way valve 145.

The second heat exchanger 144 functions as an evaporator, and the water, which is heated while passing through the second heat exchanger 144 in the water circulation pipe, evaporates the refrigerant circulating in the second heat exchanger 144.

The evaporated refrigerant is introduced into the compressor 141 to be compressed therein, and is then circulated to the first heat exchanger 142. The refrigerant circulating in the first heat exchanger 142 exchanges heat with the frost formed on the first heat exchanger 142. In this process, the frost is heated and removed.

The heat pump apparatus 1 according to the embodiment can perform interior heating without interruption even when it is operated in the defrost mode.

FIG. 5 is a diagram illustrating a state in which the heat pump apparatus illustrated in FIG. 1 is operated in a second heating mode.

The heat pump apparatus 1 according to the embodiment performs interior heating by directly using hot water supplied from the outside. Here, the hot water may be hot water for district heating, which is heated by recycling waste heat, as described above.

Similarly to operation in the defrost mode illustrated in FIG. 4, the water circulating in the water circulation pipe 151 is heated by heat exchange with the hot water supplied through the hot water pipe 170 in the third heat exchanger 161 in the second heating mode.

The heated water passes through the fan coil unit 180, and the inside may be heated by the operation of the fan coil unit 180.

However, the operation in the second heating mode differs from the operation in the defrost mode illustrated in FIG. 4 in that the operation of the refrigerant circulation unit 140 is stopped.

FIG. 6 is a diagram illustrating a state in which the heat pump apparatus illustrated in FIG. 1 is operated in a third heating mode.

In the third heating mode, the operation of the first and third blowers 112 and 132 is stopped, and only the second blower 122 is operated, so that outdoor air is introduced into the second channel 120. In this case, the cooling unit 121 is maintained in the state in which the operation thereof is stopped.

The refrigerant circulating in the refrigerant circulation unit 140 is circulated in the same direction as a direction, in which a refrigerant is circulated during operation in the first heating mode, according to the control of the four-way valve 145. Accordingly, the first heat exchanger 142 functions as an evaporator for evaporating a refrigerant using the outdoor air, which passes through the second channel 120, as a heat source.

The refrigerant evaporated in the first heat exchanger 142 is compressed by the compressor 141, and is then circulated to the second heat exchanger 144. In this case, the second heat exchanger 144 functions as a condenser. The water circulating in the water circulation pipe 151 is primarily heated while passing through the second heat exchanger 144.

The primarily heated water in the water circulation pipe 151 passes through the third heat exchanger 161. Hot water is supplied to the third heat exchanger 161 through the hot water pipe 170 according to the control of the three-way valve 51. The primarily heated water in the water circulation pipe 151 is secondarily heated by heat exchange with the hot water in the third heat exchanger 161.

The secondarily heated water passes through the fan coil unit 180. Thus, interior heating can be performed by the operation of the fan coil unit 180.

Since the water circulating in the water circulation pipe 151 is heated twice while passing through the second and third heat exchangers 144 and 161 in the third heating mode, it is possible to rapidly heat water. The heat pump apparatus 1 can rapidly perform interior heating when it is operated in the third heating mode.

Although the present invention has been described with respect to the illustrative embodiments, it should be understood that numerous other modifications and applications may be devised by those skilled in the art that will fall within the intrinsic aspects of the embodiments. More particularly, various variations and modifications are possible in concrete constituent elements of the embodiments.

In addition, it is to be understood that differences relevant to the variations and modifications fall within the spirit and scope of the present disclosure defined in the appended claims.

[Description of Reference Numerals]

| | |
|---|---|
| 1: heat pump apparatus | 50: water inlet pipe |
| 51: three-way valve | 100: housing |
| 101: desiccant rotor | 102, 103: partition wall |
| 110: first channel | 111: heating unit |
| 112: first blower | 113: hot water coil |
| 114: inlet pipe | 115: outlet pipe |
| 120: second channel | 121: cooling unit |
| 122: second blower | 123: water supply unit |
| 130: third channel | 131: cooling unit |
| 132: third blower | 133: air filter |
| 140: refrigerant circulation unit | 141: compressor |
| 142: first heat exchanger | 143: expansion valve |
| 144: second heat exchanger | 145: four-way valve |
| 151: water circulation pipe | 161: third heat exchanger |
| 170: hot water pipe | 171: supply pipe |
| 180: fan coil unit | 191: damper |

The invention claimed is:

1. A hybrid heat pump apparatus comprising:

a housing;

a first channel formed in the housing such that first air passes through the first channel;

a second channel formed in the housing such that second air passes through the second channel;

a desiccant rotor rotatably installed in the housing while being disposed over the first and second channels, so that the desiccant rotor is dried by the first air passing therethrough and absorbs moisture from the second air passing therethrough;

a heating unit disposed upstream of the desiccant rotor so as to be closer to an introduction side of the first air in the first channel, the heating unit serving to heat the first air passing therethrough;

a cooling unit disposed downstream of the desiccant rotor so as to be closer to a discharge side of the second air in the second channel, the cooling unit serving to selectively cool the second air passing therethrough;

a refrigerant circulation unit comprising a compressor, a first heat exchanger, a second heat exchanger, and a four-way valve, the first heat exchanger being disposed downstream of the cooling unit so as to be closer to the discharge side of the second air in the second channel, a refrigerant being circulated in the refrigerant circulation unit in order of the compressor, the first heat exchanger, the second heat exchanger, and the compressor or vice versa, according to control of the four-way valve; and a water circulation pipe in which water is circulated, the water circulation pipe being connected to the second heat exchanger such that the water circulating therein exchanges heat with the refrigerant in the second heat exchanger.

2. A hybrid heat pump apparatus comprising:

a housing;

a first channel formed in the housing such that first air passes through the first channel;

a second channel formed in the housing such that second air passes through the second channel;

a third channel formed in the housing such that third air passes through the third channel;

a desiccant rotor rotatably installed in the housing while being disposed over the first, second, and third channels, so that the desiccant rotor is dried by the first air passing therethrough and absorbs moisture from the second air and the third air passing therethrough;

a heating unit disposed upstream of the desiccant rotor so as to be closer to an introduction side of the first air in the first channel, the heating unit serving to heat the first air passing therethrough;

a first cooling unit disposed downstream of the desiccant rotor so as to be closer to a discharge side of the second air in the second channel, the first cooling unit serving to selectively cool the second air passing therethrough;

a second cooling unit disposed downstream of the desiccant rotor so as to be closer to a discharge side of the third air in the third channel, the second cooling unit serving to cool the third air passing therethrough;

a refrigerant circulation unit comprising a compressor, a first heat exchanger, a second heat exchanger, and a four-way valve, the first heat exchanger being disposed downstream of the first cooling unit so as to be closer to the discharge side of the second air in the second channel, a refrigerant being circulated in the refrigerant circulation unit in order of the compressor, the first heat exchanger, the second heat exchanger, and the compressor or vice versa, according to control of the four-way valve; and a water circulation pipe in which water is circulated, the water circulation pipe being connected to the second heat exchanger such that the water circulating therein exchanges heat with the refrigerant in the second heat exchanger.

3. The hybrid heat pump apparatus of claim 1, further comprising a third heat exchanger connected to the water circulation pipe such that the water circulating in the water circulation pipe via the second heat exchanger exchanges heat with a heat source which is selectively supplied to the third heat exchanger.

4. The hybrid heat pump apparatus of claim 3, wherein the third heat exchanger is connected to a hot water pipe which is selectively supplied with hot water, and the water circulating in the water circulation pipe exchanges heat with the hot water, as the heat source, flowing in the hot water pipe.

5. The hybrid heat pump apparatus of claim 1, further comprising a third heat exchanger connected to the water circulation pipe such that the water circulating in the water circulation pipe via the second heat exchanger exchanges heat with a heat source which is selectively supplied to the third heat exchanger, wherein:

the heating unit comprises a hot water coil;

the third heat exchanger is connected to a hot water pipe which is selectively supplied with hot water, and the water circulating in the water circulation pipe exchanges heat with the hot water, as the heat source, flowing in the hot water pipe; and a water inlet pipe into which hot water is introduced, a supply pipe of the hot water pipe connected to the third heat exchanger, and an inlet pipe connected to an inlet of the hot water coil are interconnected by a three-way valve.

6. The hybrid heat pump apparatus of claim 1, further comprising a blower disposed in the first or second channel such that air forcibly passes through the first or second channel.

7. The hybrid heat pump apparatus of claim 2, further comprising a blower disposed in the first, second, or third channel such that air forcibly passes through the first, second, or third channel.

8. The hybrid heat pump apparatus of claim 1, wherein at least a portion of the water circulation pipe is disposed within at least one of an interior floor, an interior ceiling, and an interior wall.

9. The hybrid heat pump apparatus of claim 1, wherein at least a portion of the water circulation pipe is disposed in a fan coil unit.

10. The hybrid heat pump apparatus of claim 1, wherein the first air is air introduced into the first channel from the outside, and the first air passing through the first channel is discharged to the outside.

11. The hybrid heat pump apparatus of claim 1, wherein the second air is air introduced into the second channel from the outside, and the second air is discharged to the outside after heat exchange in the first heat exchanger.

12. The hybrid heat pump apparatus of claim 1, further comprising a water supply unit disposed in the second channel so as to spray water on a surface of the first heat exchanger.

13. The hybrid heat pump apparatus of claim 1, wherein the heating unit comprises a hot water coil.

14. The hybrid heat pump apparatus of claim 2, wherein the third air is air introduced into the third channel from the inside, and the third air passing through the third channel is discharged to the inside.

15. The hybrid heat pump apparatus of claim 2, further comprising a damper disposed between the second and third channels, the second channel communicating with the third channel by opening/closing of the damper.

16. The hybrid heat pump apparatus of claim 2, further comprising an air filter disposed in the third channel.

17. The hybrid heat pump apparatus of claim 2, further comprising a third heat exchanger connected to the water circulation pipe such that the water circulating in the water circulation pipe via the second heat exchanger exchanges heat with a heat source which is selectively supplied to the third heat exchanger.

18. The hybrid heat pump apparatus of claim 17, wherein the third heat exchanger is connected to a hot water pipe which is selectively supplied with hot water, and the water circulating in the water circulation pipe exchanges heat with the hot water, as the heat source, flowing in the hot water pipe.

19. The hybrid heat pump apparatus of claim 2, further comprising a third heat exchanger connected to the water circulation pipe such that the water circulating in the water circulation pipe via the second heat exchanger exchanges heat with a heat source which is selectively supplied to the third heat exchanger, wherein:

the heating unit comprises a hot water coil;

the third heat exchanger is connected to a hot water pipe which is selectively supplied with hot water, and the water circulating in the water circulation pipe exchanges heat with the hot water, as the heat source, flowing in the hot water pipe; and a water inlet pipe into which hot water is introduced, a supply pipe of the hot water pipe connected to the third heat exchanger, and an inlet pipe connected to an inlet of the hot water coil are interconnected by a three-way valve.

20. The hybrid heat pump apparatus of claim 2, wherein at least a portion of the water circulation pipe is disposed within at least one of an interior floor, an interior ceiling, and an interior wall.

* * * * *